US006196008B1

(12) United States Patent
Fujitaka et al.

(10) Patent No.: US 6,196,008 B1
(45) Date of Patent: Mar. 6, 2001

(54) METHOD FOR TAKING CUSTODY OF, TRANSPORTING AND INSTALLING AIR CONDITIONER

(75) Inventors: Akira Fujitaka; Yoshinori Kobayashi; Yuichi Yakumaru, all of Shiga; Yukio Watanabe, Kyoto; Hironao Numoto, Shiga; Shigehiro Sato, Shiga; Kanji Haneda, Shiga, all of (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/315,811

(22) Filed: May 21, 1999

(30) Foreign Application Priority Data

May 26, 1998 (JP) ..... 10-161473
May 13, 1999 (JP) ..... 11-132168

(51) Int. Cl.[7] ..... F25B 45/00; F25D 19/00
(52) U.S. Cl. ..... 62/77; 62/149; 62/298
(58) Field of Search ..... 62/77, 298, 114, 62/498, 149, 304

(56) References Cited

U.S. PATENT DOCUMENTS 3,721,107 * 3/1973 Stockford et al. ..... 62/298
5,097,667 * 3/1992 Gramkow ..... 62/77
5,423,190 * 6/1995 Friedland ..... 62/149
5,557,940 * 9/1996 Hendricks ..... 62/149
5,842,349 * 12/1998 Wakita et al. ..... 62/85

FOREIGN PATENT DOCUMENTS 9-229522 9/1997 (JP) .

* cited by examiner

*Primary Examiner*—Corrine McDermott
*Assistant Examiner*—Chen-Wen Jiang
(74) *Attorney, Agent, or Firm*—Armstrong, Westerman, Hattori, McLeland & Naughton

(57) ABSTRACT

A method for taking custody of, transporting and installing an air conditioner having an outdoor unit which uses a flammable refrigerant and includes a refrigeration cycle comprising a compressor, an expansion device and an outdoor heat exchanger which are connected to one another through pipes, wherein the outdoor unit is shipped from a factory while the refrigeration cycle is evacuated to produce a vacuum, the outdoor unit is kept in custody and transported in a state in which the vacuum in the refrigeration cycle is maintained, and when the outdoor unit is installed, the flammable refrigerant is charged into the refrigeration cycle. With this structure, it is possible to provide a method for taking custody of, transporting and installing an apparatus having a refrigeration cycle in which safety is assured when the apparatus having the refrigeration cycle is being transported or kept in custody, the efficiency of the disposing operation is enhanced, and a problem such as deterioration of performance is not generated.

10 Claims, 5 Drawing Sheets

METHOD FOR TAKING CUSTODY OF, TRANSPORTING AND INSTALLING AIR CONDITIONER

TECHNICAL FIELD

The present invention relates to a method for taking custody of, transporting and installing an apparatus having a refrigeration cycle, especially, an air conditioner which uses a flammable refrigerant comprising, as a main component, one of propane, isobutane and ethane, or a mixture of a plurality of these components.

BACKGROUND TECHNIQUE

HCFC-based refrigerants such as R22, which are stable components and composed of hydrogen, chlorine, fluorine and carbon are currently utilized in an air conditioner.

However, HCFC-based refrigerants rise into the stratosphere and deplete ozone, leading to the depletion of the ozone layer.

In recent years, HFC-based refrigerants begin to be utilized as alternative refrigerants of HCFCs, but these HFC-based refrigerants have the nature for facilitating the global warming.

Therefore, a study is started to employ HC-based refrigerant which does not destroy the ozone layer or largely affect the global warming.

However, since this HC-based refrigerant is flammable, it is necessary to prevent explosion or ignition so as to ensure the safety.

Especially, if a large amount of the flammable refrigerant leaks while the apparatus having the refrigeration cycle is transported or kept in custody, there is a danger of accident such as explosion or ignition.

In order to solve such a problem, it is proposed to charge non-flammable gas into the refrigeration cycle while the apparatus having the refrigeration cycle is transported or kept in custody (e.g., Japanese Patent Application Laid-open No.H9-229522)

However, if the non-flammable gas is charged in the refrigeration cycle, when the apparatus having the refrigeration cycle is installed, the non-flammable gas must be removed by evacuation. If the refrigerant is charged in a state where the non-flammable gas remains, there is a problem that the performance of the refrigeration cycle is deteriorated when it is used.

Thereupon, it is an object of the present invention to provide a method for taking custody of, transporting and installing an apparatus having a refrigeration cycle in which safety is assured when the apparatus having the refrigeration cycle is being transported or kept in custody, the disposing operation saves the time or trouble, or can more easily or simply, and a problem such as deterioration of performance is not generated.

DISCLOSURE OF THE INVENTION

To achieve the above object, according to a first aspect of the present invention, there is provided a method for taking custody of, transporting and installing an air conditioner having an outdoor unit which uses a flammable refrigerant and includes a refrigeration cycle comprising a compressor, an expansion device and an outdoor heat exchanger which are connected to one another through pipes, wherein the outdoor unit is shipped from a factory while the refrigeration cycle is evacuated to produce a vacuum, the outdoor unit is kept in custody and transported in a state in which the vacuum in the refrigeration cycle is maintained, and when the outdoor unit is installed, the flammable refrigerant is charged into the refrigeration cycle.

According to a second aspect, there is provided method for taking custody of, transporting and installing an apparatus having a refrigeration cycle which uses a flammable refrigerant, wherein the apparatus is shipped from a factory while the refrigeration cycle is evacuated to produce a vacuum, the apparatus is kept in custody and transported in a state in which the vacuum in the refrigeration cycle is maintained, and when the apparatus is installed, the flammable refrigerant is charged into the refrigeration cycle.

With the first or second aspect, the refrigeration cycle is in the vacuum state and the flammable refrigerant is not charged, and in this state, the refrigerant is kept in custody and transported. Therefore, there is no problem of leakage of the flammable refrigerant. Further, the pressure is brought into a vacuum and no other gas is charged, it is unnecessary to remove the gas at the time of installation, and there is no problem for deteriorating the performance due to gas residue. Further, at the time of installation, since the pressure is in the vacuum state, the refrigerant to be used can be charged as it is, the efficiency of the installation is enhanced.

According to a third aspect, there is provided a method for taking custody of, transporting and installing an air conditioner having an outdoor unit which uses a flammable refrigerant and includes a refrigeration cycle comprising a compressor, an expansion device and an outdoor heat exchanger which are connected to one another through pipes, wherein the flammable refrigerant is charged into the refrigeration cycle at the pressure close to the atmospheric pressure and the outdoor unit is shipped from a factory, the outdoor unit is kept in custody and transported in a state in which the flammable refrigerant is charged into the refrigeration cycle at the pressure close to the atmospheric pressure, and when the outdoor unit is installed, a flammable refrigerant is supplemented into the refrigeration cycle.

According to a fourth aspect, there is provided a method for taking custody of, transporting and installing an apparatus having a refrigeration cycle which uses a flammable refrigerant, wherein the flammable refrigerant is charged into the refrigeration cycle at the pressure close to the atmospheric pressure and the apparatus is shipped from a factory, the apparatus is kept in custody and transported in a state in which the flammable refrigerant is charged into the refrigeration cycle at the pressure close to the atmospheric pressure, and when the apparatus is installed, a flammable refrigerant is supplemented into the refrigeration cycle.

With the third or fourth aspect, since the refrigeration cycle is kept in custody and transported in a state in which the flammable refrigerant is charged into the refrigeration cycle at the pressure close to the atmospheric pressure, even if the pipe is cracked due to vibration or the like, since a large amount of flammable refrigerant should not leak, the probability that the leakage brings about the explosion or the ignition is extremely low. Further, it is unnecessary to be evacuated at the time of the installation, and only the shortage amount of the refrigerant may be supplemented, the efficiency of the operation is enhanced.

According to a fifth aspect, there is provided a method for taking custody of, transporting and installing an air conditioner having an outdoor unit which uses a flammable refrigerant and includes a refrigeration cycle comprising a compressor, an expansion device and an outdoor heat exchanger which are connected to one another through pipes, said outdoor unit being accommodated in a packaging and shipped from a factory, kept in storage and transported, wherein said flammable refrigerant is charged into a volume of a gap in said packaging in a state in which said outdoor unit is accommodated therein in such an amount that a concentration of said flammable refrigerant becomes lower than a lower flammability limit, said outdoor unit is shipped from the factory, kept in storage and transported, and when said outdoor unit is installed, said flammable refrigerant is supplementary charged into said refrigeration cycle.

According to a sixth aspect, there is provided a method for taking custody of, transporting and installing an apparatus having a refrigeration cycle which uses a flammable refrigerant, said apparatus being accommodated in a packaging and shipped from a factory, kept in storage and transported, wherein said flammable refrigerant is charged into a volume of a gap in said packaging in a state in which said apparatus is accommodated in such an amount that a concentration of said flammable refrigerant becomes lower than a lower flammability limit, said apparatus is shipped from the factory, kept in storage and transported, and when said apparatus is installed, said flammable refrigerant is supplementary charged into said refrigeration cycle.

With the fifth or sixth aspect, since the flammable refrigerant is charged into a volume of a gap in the packaging in a state in which the outdoor unit or the apparatus is accommodated in such an amount that a concentration of the flammable refrigerant becomes lower than a lower flammability limit, even if a crack is generated in the pipe or the like by vibration or the like and the flammable refrigerant leaks into the packaging, the possibility that explosion or ignition is induced is extremely small because concentration of the flammable refrigerant is lower than the lower flammability limit. Further, at the time of installation, troublesome operation such as evacuation is unnecessary, and since only supplement of a shortfall suffices, the operation efficiency is high.

According to a seventh aspect, there is provided a method for taking custody of, transporting and installing an air conditioner having an outdoor unit which uses a flammable refrigerant and includes a refrigeration cycle comprising a compressor, an expansion device and an outdoor heat exchanger which are connected to one another through pipes, wherein a refrigerant cylinder capable of connecting with the refrigeration cycle is provided, a flammable refrigerant is charged into the refrigerant cylinder and the refrigeration cycle is evacuated to produce a vacuum and the outdoor unit is shipped from a factory, the outdoor unit is kept in custody and transported in a state in which the vacuum in the refrigeration cycle is maintained, and when the outdoor unit is installed, the flammable refrigerant is charged into the refrigeration cycle from the refrigerant cylinder.

According to an eighth aspect, there is provided a method for taking custody of, transporting and installing an apparatus having a refrigeration cycle which uses a flammable refrigerant, wherein a refrigerant cylinder capable of connecting with the refrigeration cycle is provided, a flammable refrigerant is charged into the refrigerant cylinder and the refrigeration cycle is evacuated to produce a vacuum and the apparatus is shipped from a factory, the apparatus is kept in custody and transported in a state in which the vacuum in the refrigeration cycle is maintained, and when the apparatus is installed, the flammable refrigerant is charged into the refrigeration cycle from the refrigerant cylinder.

With the seventh or eighth aspect, since the flammable refrigerant is charged into the refrigerant cylinder and the refrigeration cycle is evacuated to produce a vacuum, even if the pipe is cracked due to the vibration or the like, the flammable refrigerant should not leak. Further, since the flammable refrigerant charged in the refrigerant cylinder may be charged into the refrigeration cycle at the time of installation, the efficiency of the operation is enhanced.

According to a ninth aspect, there is provided a method for taking custody of, transporting and installing an air conditioner having an outdoor unit which uses a flammable refrigerant and includes a refrigeration cycle comprising a compressor, an expansion device and an outdoor heat exchanger which are connected to one another through pipes, wherein a refrigerant cylinder capable of connecting with the refrigeration cycle is provided, the flammable refrigerant is charged into the refrigeration cycle at the pressure close to the atmospheric pressure and the shortage amount of flammable refrigerant is charged into the refrigerant cylinder, and the outdoor unit is shipped from a factory, the outdoor unit is kept in custody and transported in a state in which the flammable refrigerant is charged into the refrigeration cycle at the pressure close to the atmospheric pressure, and when the outdoor unit is installed, a flammable refrigerant is supplemented from the refrigerant cylinder into the refrigeration cycle.

According to a tenth aspect, there is provided a method for taking custody of, transporting and installing an apparatus having a refrigeration cycle which uses a flammable refrigerant, wherein a refrigerant cylinder capable of connecting with the refrigeration cycle is provided, the flammable refrigerant is charged into the refrigeration cycle at the pressure close to the atmospheric pressure and the shortage amount of flammable refrigerant is charged into the refrigerant cylinder, and the apparatus is shipped from a factory, the apparatus is kept in custody and transported in a state in which the flammable refrigerant is charged into the refrigeration cycle at the pressure close to the atmospheric pressure, and when the apparatus is installed, a flammable refrigerant is supplemented from the refrigerant cylinder into the refrigeration cycle.

With the ninth or tenth aspect, since the apparatus is kept in custody and transported in a state in which the flammable refrigerant is charged into the refrigeration cycle at the pressure close to the atmospheric pressure, even if the pipe is cracked due to the vibration or the like, a large amount of flammable refrigerant should not leak, and the probability that the explosion or the ignition is caused is extremely low. Further, since it is unnecessary to be evacuated at the time of installation, and the shortage amount of refrigerant can be supplemented from the refrigerant cylinder, the efficiency of the operation is enhanced.

According to an eleventh aspect, there is provided a method for taking custody of, transporting and installing an air conditioner having an outdoor unit which uses a flammable refrigerant and includes a refrigeration cycle comprising a compressor, an expansion device and an outdoor heat exchanger which are connected to one another through pipes, said outdoor unit being accommodated in a packaging and shipped from a factory, kept in storage and transported, wherein a refrigerant cylinder capable of connecting with said refrigeration cycle is provided, said flammable refrigerant is charged into a volume of a gap in said packaging in a state in which said outdoor unit is accommodated therein in such an amount that a concentration of said flammable refrigerant becomes lower than a lower flammability limit, and remaining flammable refrigerant is charged into said refrigerant cylinder, and said outdoor unit is shipped from the factory, kept in storage and transported, and when said outdoor unit is installed, said flammable refrigerant is supplementary charged into said refrigeration cycle from said refrigerant cylinder.

According to a twelfth aspect, there is provided a method for taking custody of, transporting and installing an apparatus having a refrigeration cycle which uses a flammable refrigerant, said apparatus being accommodated in a packaging and shipped from a factory, kept in storage and transported, wherein a refrigerant cylinder capable of connecting with said refrigeration cycle is provided, said flammable refrigerant is charged into a volume of a gap in said packaging in a state in which said outdoor unit is accommodated therein in such an amount that a concentration of said flammable refrigerant becomes lower than a lower flammability limit, and remaining flammable refrigerant is charged into said refrigerant cylinder, and said outdoor unit is shipped from the factory, kept in storage and transported, and when said outdoor unit is installed, said flammable refrigerant is supplementary charged into said refrigeration cycle from said refrigerant cylinder.

With the eleventh or twelfth aspect, the flammable refrigerant is charged into a volume of a gap in the packaging in a state in which the outdoor unit is accommodated therein in such an amount that a concentration of the flammable refrigerant becomes lower than a lower flammability limit, and the outdoor unit or the apparatus is kept in storage and transported. Therefore, even if a crack is generated in the pipe or the like by vibration or the like and the flammable refrigerant leaks into the packaging, the possibility that explosion or ignition is induced is extremely small because concentration of the flammable refrigerant is lower than the lower flammability limit. Further, at the time of installation, evacuation is unnecessary, and since only supplement of a shortfall from the refrigerant cylinder suffices, the operation efficiency is high.

According to a thirteenth aspect, in the third, fifth, ninth or eleventh aspect, as a lubricant used in said compressor, a lubricant having non solubility or less solubility with a flammable refrigerant.

According to a fourteenth aspect, in the fourth, sixth, tenth or twelfth aspect, as a lubricant used in said compressor constituting said refrigeration cycle, a lubricant having non solubility or less solubility with a flammable refrigerant.

With the thirteenth or fourteenth aspect, in any one of the third to sixth or ninth to twelfth aspects, as a lubricant used in the compressor constituting the refrigeration cycle, a lubricant having non solubility or less solubility with a flammable refrigerant. Since the lubricant having non solubility or less solubility with the flammable refrigerant is used, the flammable refrigerant previously charged into the refrigeration cycle should not be dissolved into the lubricant even if the temperature is changed. Therefore, the pressure in the refrigeration cycle should not be varied at the time of custody and transportation. Therefore, even if the pipe is cracked due to vibration or the like and the refrigerant leaks, since a large amount of flammable refrigerant should not leak, the probability that the leakage brings about the explosion or the ignition is extremely low.

According to a fifteenth aspect, there is provided an outdoor unit of an air conditioner including a refrigeration cycle comprising a compressor, an expansion device and an outdoor heat exchanger which are connected to one another through pipes, wherein a refrigerant cylinder into which a flammable refrigerant is charged is connected to said refrigeration cycle through a valve capable of opening and closing said refrigerant cylinder, said refrigeration cycle is in a vacuum state, or said flammable refrigerant is charged into a volume of a gap in said packaging in a state in which said outdoor unit is accommodated therein in such an amount that a pressure in said refrigeration cycle becomes close to the atmospheric pressure or a concentration of said flammable refrigerant becomes lower than a lower flammability limit.

According to a sixteenth aspect, there is provided an apparatus having a refrigeration cycle, wherein a refrigerant cylinder into which a flammable refrigerant is charged is connected to said refrigeration cycle through a valve capable of opening and closing said refrigerant cylinder, said refrigeration cycle is in a vacuum state, or said flammable refrigerant is charged into a volume of a gap in said packaging in a state in which said outdoor unit is accommodated therein in such an amount that a pressure in said refrigeration cycle becomes close to the atmospheric pressure or a concentration of said flammable refrigerant becomes lower than a lower flammability limit.

With the fifteenth or sixteenth aspect, even if the pipe is cracked due to vibration or the like at the time of custody or transportation, a large amount of flammable refrigerant should not leak, and the flammable refrigerant charged into the refrigerant cylinder can be used at the time of installation, the efficiency of the operation is enhanced.

According to a seventeenth aspect, in third or ninth aspect, an amount of said flammable refrigerant to be charged into said refrigeration cycle when said refrigeration cycle is shipped from a factory, kept in storage and transported is equal to or smaller than atmospheric pressure.

According to an eighteenth aspect, in the third or ninth aspect, an amount of said flammable refrigerant to be charged into said refrigeration cycle when said refrigeration cycle is shipped from a factory, kept in storage and transported is equal to or greater than atmospheric pressure.

According to a nineteenth aspect, in the fourth or tenth aspect, an amount of said flammable refrigerant in said refrigeration cycle when said refrigeration cycle is shipped from a factory, kept in storage and transported is equal to or smaller than atmospheric pressure.

According to a twentieth aspect, in the fourth or tenth aspect, an amount of said flammable refrigerant in said refrigeration cycle when said refrigeration cycle is shipped from a factory, kept in storage and transported is equal to or greater than atmospheric pressure.

With the seventeenth or nineteenth aspect, by lowering the pressure to a value equal to or smaller than atmospheric pressure, even if a crack is generated in the pipe or the like by vibration or the like when the refrigeration cycle is kept in storage and transported, the refrigerant should not be injected, and the refrigerant gradually leaks outside the pipe while being mixed with the air in the pipe and thus, the possibility that explosion or ignition is induced is extremely small.

With the eighteenth or twentieth aspect, since the refrigerant is charged at pressure equal to or greater than atmospheric pressure in a state close to atmospheric pressure, even if a crack is generated in the pipe or the like by vibration or the like when the refrigeration cycle is kept in storage and transported, the great amount of refrigerant should not be injected, and the possibility that explosion or ignition is induced is extremely small. Further, since the refrigerant equal to or greater than atmospheric pressure is charged, if the valve is slightly opened at the time of installation to check whether the refrigerant is injected, it is possible to judge whether the refrigerant leaks.

According to a twenty-first aspect, a flammable refrigerant in a refrigeration cycle is charged at a pressure equal to or smaller than atmospheric pressure.

According to a twenty-second aspect, a flammable refrigerant in a refrigeration cycle is charged at a pressure equal to or smaller than atmospheric pressure.

With the twenty-first or twenty-second aspect, by lowering the pressure to a value equal to or smaller than atmospheric pressure, even if a crack is generated in the pipe or the like by vibration or the like when the refrigeration cycle is kept in storage and transported, the refrigerant should not be injected, and the refrigerant gradually leaks outside the pipe while being mixed with the air in the pipe and thus, the possibility that explosion or ignition is induced is extremely small.

BEST MODE FOR CARRYING OUT THE INVENTION

Figure 1:
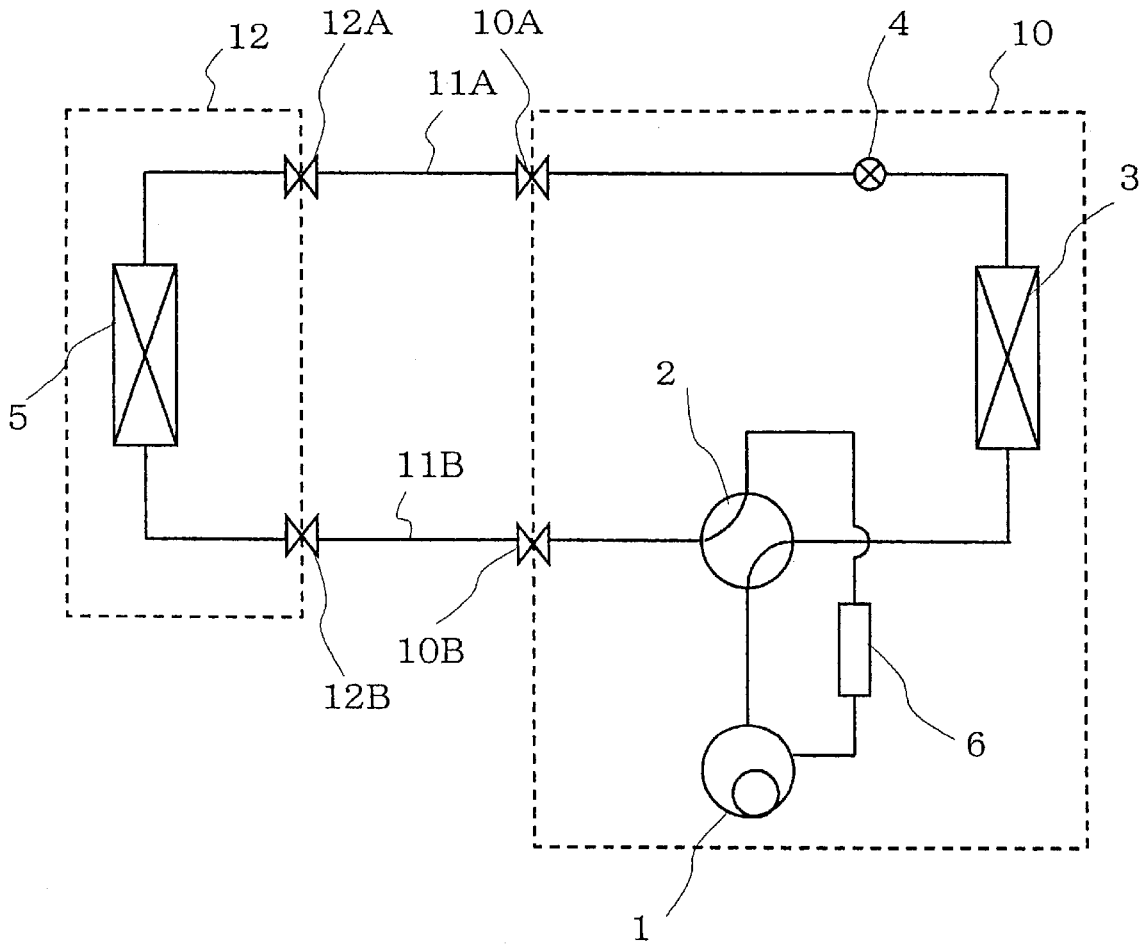
FIG. 1 is a view showing a refrigeration cycle according to a first embodiment of an air conditioner of the present invention.

A refrigeration cycle of an air conditioner according to a first embodiment of the present invention will be explained with reference to the drawing below.

FIG. 1 is a view of a refrigeration cycle in its installed state.

As shown in FIG. 1, a compressor 1, a 4-way valve 2, an outdoor heat exchanger 3, an expansion device 4, an indoor heat exchanger 5 and an accumulator 6 are annularly connected with one another through pipes, thereby forming a refrigeration cycle. The outdoor heat exchanger 3 functions as a condenser at the time of cooling operation, and functions as an evaporator at the time of heating operation. The indoor heat exchanger 5 functions as an evaporator at the time of cooling operation, and functions as a condenser at the time of heating operation.

An outdoor unit 10 includes the compressor 1, the 4-way valve 2, the outdoor heat exchanger 3, the expansion device 4 and the accumulator 6, and also includes connection valves 10A and 10B for connecting pipes 11A and 11B. An indoor unit 12 includes the indoor heat exchanger 5, and also includes connection valves 12A and 12B for connecting the connection pipes 11A and 11B.

Referring to FIG. 1 showing the refrigeration cycle, the factory-shipped state will be explained first.

When the air conditioner is factory-divided into the outdoor unit 10, the indoor unit 12, and the connection pipes 11A and 11B so that the air conditioner can easily be transported. The outdoor unit 10 comprises the compressor 1, the 4-way valve 2, the outdoor heat exchanger 3, the expansion device 4 and the accumulator 6 between the connection valves 10A and 10B. In this refrigeration cycle, the pipes are evacuated, and the connection valves 10A and 10B are closed. The indoor unit 12 forms a refrigeration cycle comprising the indoor heat exchanger 5 connected between the connection valves 12A and 12B. The pressure in the refrigeration cycle constituted by the indoor unit 12 and the connection pipes 11A and 1lB are brought into atmospheric pressure.

Figure 5:
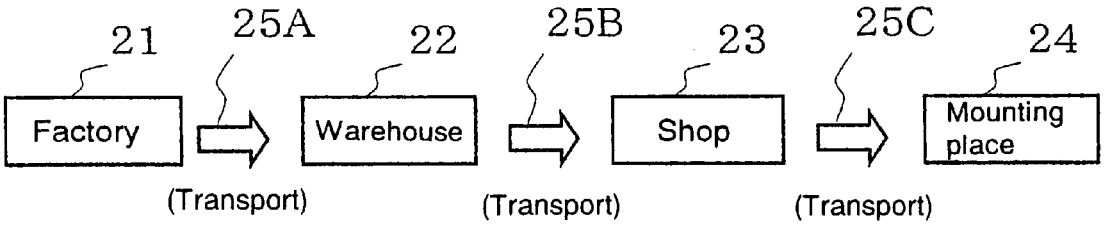
FIG. 5 is a block diagram for explaining the distribution process of the air conditioner or the apparatus having the refrigeration cycle.

Next, one example of the distribution process of the air conditioner will be explained simply using FIG. 5.

When the air conditioner is shipped from a factory 21, the outdoor unit 10 is shipped in a state where the pressure in the refrigeration cycle constituted by the outdoor unit 10 is maintained at vacuum as explained above. After the air conditioner is shipped, it is once kept in custody in a warehouse 22 and then, it is delivered to a shop 23. Then, the air conditioner is installed in a mounting place 24. In transportation processes 25A, 25B and 25C, and custody processes 22 and 23 from the shipment from the factory 21 to the mounting place 24, an interior of the refrigeration cycle constituted by the outdoor unit 10 is in a vacuum state.

Next, returning to FIG. 1, a method of installing the air conditioner will be explained simply.

The outdoor unit 10 and the indoor unit 12 are disposed in predetermined positions. Then, the connection pipes 11A and 11B are first connected to the indoor unit 12. Then, a refrigerant is charged. Before the refrigerant is charged, it is preferable to detect whether the refrigeration cycle of the outdoor unit 10 is in the vacuum state, and to judge whether the air-tight state is maintained in the refrigeration cycle. The connection valve 10A or 10B is connected to a refrigerant cylinder, and the refrigerant is charged into the refrigeration cycle in the outdoor unit 10. Since the interior of the refrigeration cycle of the outdoor unit 10 is in vacuum state, it is unnecessary to be evacuated prior to the charging of the refrigerant. When the charging of the refrigerant into the outdoor unit 10 is completed, the connection pipes 11A and 11B are connected to the connection valves 10A and 10B. At that time, the one to wait until the refrigerant gas is injected from the other connection pipe 11A and then, the other connection pipe 11A is connected to the connection valve 10A. By providing such a time-lag in the connecting operation, air in the connection pipes 11A and 11B as well as in the refrigeration cycle of the indoor unit 12 is purged by the refrigerant gas. In this manner, connection of the refrigeration cycle as the air conditioner is completed.

Next, the refrigeration cycle of the apparatus according to the first embodiment of the present invention will be explained based on FIG. 2.

Examples of apparatuses using such a refrigeration cycle are a refrigerator, a freezer, a showcase and a vending machine, in addition to the air conditioner.

Figure 2:
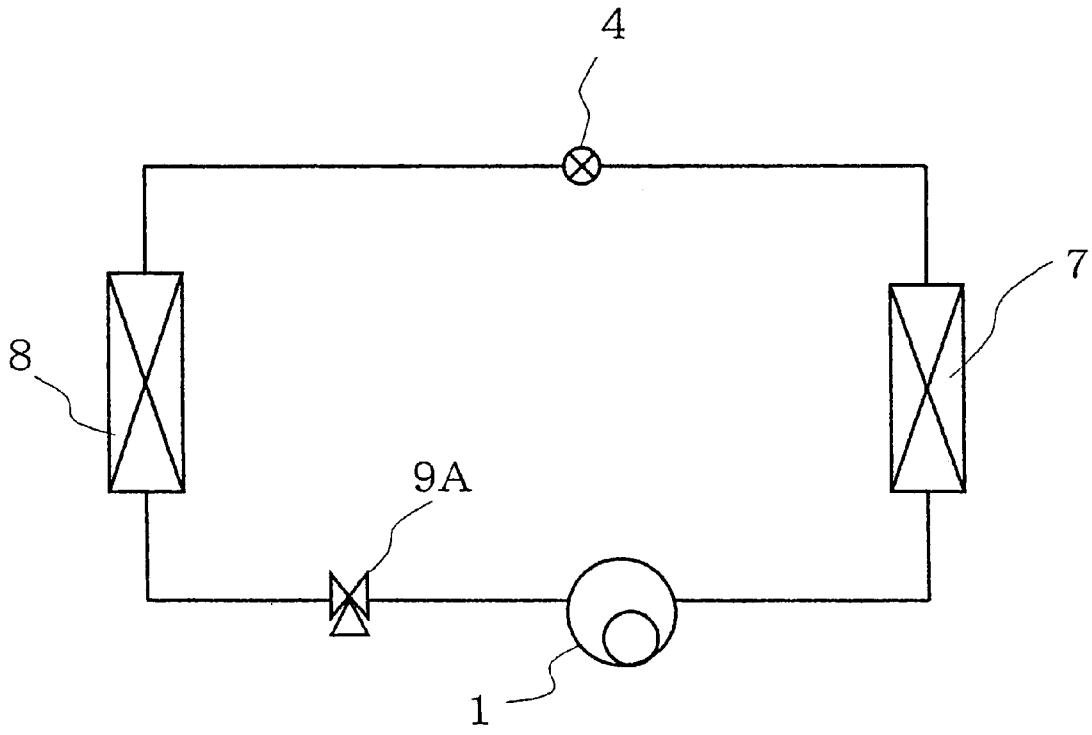
FIG. 2 is a view showing a refrigeration cycle according to the first embodiment of an apparatus having the refrigeration cycle of the present invention.

As shown in FIG. 2, the refrigeration cycle comprises the compressor 1, the condenser 7, the expansion device 4 and an evaporator 8 which are annularly connected to one another through the pipes. A valve 9A for charging the refrigerant is provided in the refrigeration cycle.

When this apparatus having the refrigeration cycle is shipped from the factory, the refrigerant is not charged, and the pressure in the pipes is in a vacuum state. Further, as shown in FIG. 5, the interior of the refrigeration cycle is kept at vacuum pressure in the custody processes (a warehouse 22, a store 23) and the transport processes 25A, 25B and 25C from a time point after the apparatus having the refrigeration cycle is shipped from the factory 21 to a time point until the apparatus reaches the mounting place 24. After the shipment, the apparatus is once kept in custody in the warehouse 22 and then, the apparatus is delivered to the store 23 and then, the apparatus is installed in the mounting place 24.

In the mounting place 24, the refrigerant is charged into the refrigeration cycle. The refrigerant cylinder is connected to the valve 9A, and the refrigerant is charged. Since the refrigeration cycle is in vacuum, it is unnecessary to be evacuated prior to the charging of the refrigerant. Before the refrigerant is charged, it is preferable to detect whether the refrigeration cycle of the outdoor unit 10 is in the vacuum state, and to judge whether the air-tight state is maintained in the refrigeration cycle.

Next, a refrigeration cycle of an air conditioner according to another embodiment of the present invention will be explained based on FIG. 3.

This other embodiment is different from the first embodiment shown in FIG. 1 in that a refrigerant cylinder 9 is connected between the 4-way valve 2 and the connection valve 10B through a valve 9A. In the refrigerant cylinder 9, the required amount of refrigerant for operating the air conditioner is charged. However, the valve 9A is occluded, the pressure in the refrigeration cycle comprising the compressor 1, the 4-way valve 2, the outdoor heat exchanger 3 and the expansion device 4 which are annularly connected to one another is in vacuum state as in the first embodiment shown in FIG. 1. The refrigerant cylinder 9 has already been provided when the air conditioner is shipped from the factory, but the state of the outdoor unit 10 in the distribution process of the air conditioner shown in FIG. 5 is the same as that in the first embodiment shown in FIG. 1.

Since the refrigerant cylinder 9 is provided, it is unnecessary to prepare another refrigerant cylinder for charging the refrigerant in the mounting place 24. After the refrigerant is charged into the refrigeration cycle, the refrigerant cylinder 9 can be detached. The refrigerant cylinder 9 may be used for collecting the refrigerant when the air conditioner is moved or scrapped. Before the refrigerant is charged, it is preferable to detect whether the refrigeration cycle of the outdoor unit 10 is in the vacuum state, and to judge whether the air-tight state is maintained in the refrigeration cycle.

Next, a refrigeration cycle of the apparatus according to another embodiment of the present invention will be explained based on FIG. 4.

Figure 3:
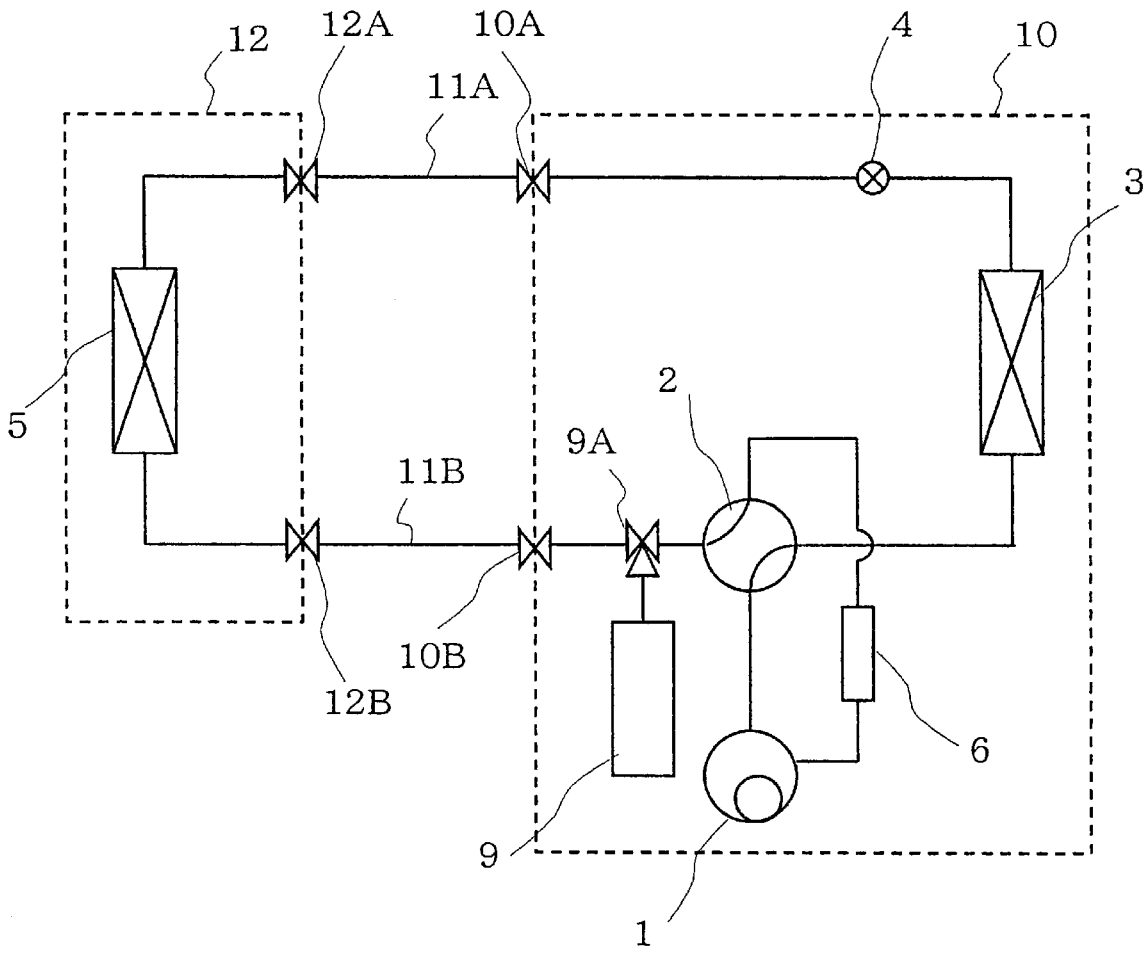
FIG. 3 is a view showing a refrigeration cycle according to another embodiment of an air conditioner of the present invention.

This embodiment is different from the previous embodiment shown in FIG. 3 in that the refrigerant cylinder 9 is connected to the valve 9A. In the refrigerant cylinder 9, the required amount of refrigerant for operating the air conditioner is charged. However, the valve 9A is occluded, the pressure in the refrigeration cycle comprising the compressor 1, the 4-way valve 2, the condenser 7, the expansion device 4 and the evaporator 8 which are annularly connected to one another is in vacuum state as in the embodiment shown in FIG. 2. The refrigerant cylinder 9 has already been provided when the air conditioner is shipped from the factory, but the state of the outdoor unit 10 in the distribution process of the air conditioner shown in FIG. 5 is the same as that in the embodiment shown in FIG. 2.

Since the refrigerant cylinder 9 is provided, it is unnecessary to prepare another refrigerant cylinder for charging the refrigerant in the mounting place 24. After the refrigerant is charged into the refrigeration cycle, the refrigerant cylinder 9 can be detached. The refrigerant cylinder 9 may be used for collecting the refrigerant when the air conditioner is moved or scrapped. Before the refrigerant is charged, it is preferable to detect whether the refrigeration cycle of the outdoor unit 10 is in the vacuum state, and to judge whether the air-tight state is maintained in the refrigeration cycle.

Figure 4:
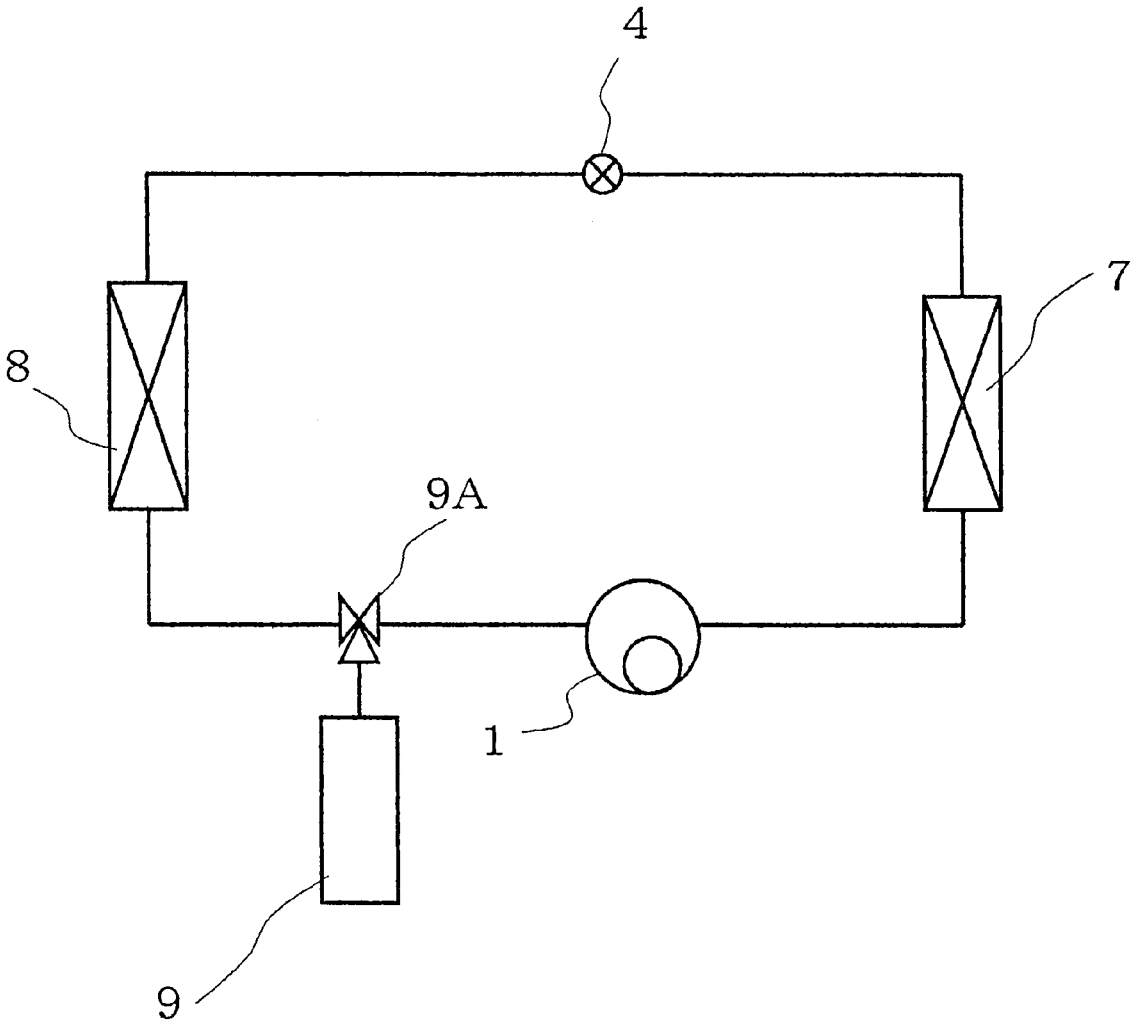
FIG. 4 is a view showing a refrigeration cycle according to the other embodiment of an apparatus having the refrigeration cycle of the present invention.

In each of the embodiments shown in FIGS. 1 to 4, the refrigeration cycle constituting the outdoor unit 10 of the air conditioner or the refrigeration cycle constituting the apparatus is in the vacuum state when it is shipped from the factory 21. Alternatively, it is also effective to charge the refrigerant used for operation at the pressure close to the atmospheric pressure, instead of vacuum state. By charging the refrigerant at the pressure close to the atmospheric pressure, only the shortage amount of the refrigerant may be charged at the mounting place. If the refrigerant cylinder 9 is previously provided as shown in FIGS. 3 and 4, the volume of the refrigerant cylinder 9 can be reduced, or it is possible to reduce the thickness of the cylinder. Further, even if the pipe or the like is damaged when the air conditioner or the apparatus having the refrigeration cycle is transported or kept in custody, there is few danger that the large amount of refrigerant is injected.

Further, when the refrigerant is charged into a state close to atmospheric pressure, since the pressure is lowered to a value equal to or smaller than atmospheric pressure, even if a crack is generated in the pipe or the like by vibration or the like when the refrigeration cycle is kept in storage and transported, the refrigerant should not be injected, and the refrigerant gradually leaks outside the pipe while being mixed with the air in the pipe and thus, the possibility that explosion or ignition is induced is extremely small.

Furthermore, when the refrigerant is charged into a state close to atmospheric pressure, since the refrigerant equal to or greater than atmospheric pressure is charged, if the valve is slightly opened at the time of installation to check whether the refrigerant is injected, it is possible to judge whether the refrigerant leaks.

Further, in each of the embodiments shown in FIGS. 1 to 4, instead of bringing the inside of the refrigeration cycle constituting the outdoor unit 10 of the air conditioner or the inside of the refrigeration cycle constituting the apparatus having the refrigeration cycle into a vacuum state at the time of shipment from the factory 21, it is also effective to charge the flammable refrigerant into a volume of a gap in the packaging in a state in which the outdoor unit or the apparatus is accommodated in such an amount that a concentration of the flammable refrigerant becomes lower than a lower flammability limit. In this case, the packaging is an exterior box. If the air-tight property of the exterior box is low, the amount of the refrigerant may slightly exceed the lower flammability limit concentration with respect to the volume of the gap of the packaging. In this manner, since the flammable refrigerant is charged into the volume of the gap in the packaging in a state in which the outdoor unit or the apparatus is accommodated in such an amount that a concentration of the flammable refrigerant becomes lower than a lower flammability limit, even if a crack is generated in the pipe or the like by vibration or the like and the flammable refrigerant leaks into the packaging, the possibility that explosion or ignition is induced is extremely small because concentration of the flammable refrigerant is lower than the lower flammability limit. Further, at the time of installation, troublesome operation such as evacuation is unnecessary, and since only supplement of a shortfall suffices, the operation efficiency is high. The amount of refrigerant corresponding to the lower flammability limit concentration is about 38 $g/m^3$ when propane (R290) is used as the refrigerant, and the lower flammability limit concentration (LFL) is 2.1 vol %.

Used in the refrigeration cycle is an HC-based flammable refrigerant comprising, as a main component, one of propane, isobutane and ethane, or a mixture of a plurality of these components. As a lubricant in the compressor 1, a lubricant having no solubility or less solubility with the HC-based refrigerant is used. As such a lubricant, one comprising carbonate compound is effective, and a lubricant in which the number of carbon forming carbonic acid ester bond occupies at least 10 atomic % of all the number of carbon forming the carbonate compound is excellent.

Preferably, the mutual solubility between the HC-based refrigerant and the lubricant is 5 wt % or less at 25° C.

As described above, according to the present invention, the safety is ensured during transportation or in the custody state of the air conditioner or the apparatus having the refrigeration cycle, and the operation efficiency is enhanced when the air conditioner or the apparatus having the refrigeration cycle is installed, and the performance thereof is not deteriorated.

What is claimed is:

1. A method for taking custody of, transporting and installing an air conditioner having an outdoor unit which uses a flammable refrigerant and includes a refrigeration cycle comprising a compressor, an expansion device and an outdoor heat exchanger which are connected to one another through pipes, wherein said flammable refrigerant is charged into said refrigeration cycle at the pressure close to the atmospheric pressure and said outdoor unit is shipped from a factory, said outdoor unit is kept in custody and transported in a state in which said flammable refrigerant is charged into said refrigeration cycle at the pressure close to the atmospheric pressure, and when said outdoor unit is installed, a flammable refrigerant is supplemented into said refrigeration cycle.

2. A method for taking custody of, transporting and installing an air conditioner having an outdoor unit which uses a flammable refrigerant and includes a refrigeration cycle comprising a compressor, an expansion device and an outdoor heat exchanger which are connected to one another through pipes, wherein a refrigerant cylinder capable of connecting with said refrigeration cycle is provided, said flammable refrigerant is charged into said refrigeration cycle at the pressure close to the atmospheric pressure and the shortage amount of flammable refrigerant is charged into said refrigerant cylinder, and said outdoor unit is shipped from a factory, said outdoor unit is kept in custody and transported in a state in which said flammable refrigerant is charged into said refrigeration cycle at the pressure close to the atmospheric pressure, and when said outdoor unit is installed, a flammable refrigerant is supplemented from said refrigerant cylinder into said refrigeration cycle.

3. A method for taking custody of, transporting and installing an air conditioner according to any one of claims 1 or 2 wherein as a lubricant used in said compressor, said lubricant having non solubility or less solubility with a flammable refrigerant.

4. A method for taking custody of, transporting and installing an air conditioner according to claim 1 or 2, wherein an amount of said flammable refrigerant to be charged into said refrigeration cycle when said refrigeration cycle is shipped from a factory, kept in storage and transported is equal to or smaller than atmospheric pressure.

5. A method for taking custody of, transporting and installing an air conditioner according to claim 1 or 2, wherein an amount of said flammable refrigerant to be charged into said refrigeration cycle when said refrigeration cycle is shipped from a factory, kept in storage and transported is equal to or greater than atmospheric pressure.

6. A method for taking custody of, transporting and installing an apparatus having a refrigeration cycle which uses a flammable refrigerant, wherein said flammable refrigerant is charged into said refrigeration cycle at the pressure close to the atmospheric pressure and said apparatus is shipped from a factory, said apparatus is kept in custody and transported in a state in which said flammable refrigerant is charged into said refrigeration cycle at the pressure close to the atmospheric pressure, and when said apparatus is installed, a flammable refrigerant is supplemented into said refrigeration cycle.

7. A method for taking custody of, transporting and installing an apparatus having a refrigeration cycle which uses a flammable refrigerant, wherein a refrigerant cylinder capable of connecting with said refrigeration cycle is provided, said flammable refrigerant is charged into said refrigeration cycle at the pressure close to the atmospheric pressure and the shortage amount of flammable refrigerant is charged into said refrigerant cylinder, and said apparatus is shipped from a factory, said apparatus is kept in custody and transported in a state in which said flammable refrigerant is charged into said refrigeration cycle at the pressure close to the atmospheric pressure, and when said apparatus is installed, a flammable refrigerant is supplemented from said refrigerant cylinder into said refrigeration cycle.

8. A method for taking custody of, transporting and installing an apparatus having a refrigeration cycle according to any one of claims 6 or 7 wherein as a lubricant used in said compressor constituting said refrigeration cycle, said lubricant having non solubility or less solubility with a flammable refrigerant.

9. A method for taking custody of, transporting and installing an apparatus having a refrigeration cycle according to claim 6 or 7, wherein an amount of said flammable refrigerant in said refrigeration cycle when said refrigeration cycle is shipped from a factory, kept in storage and transported is equal to or smaller than atmospheric pressure.

10. A method for taking custody of, transporting and installing an apparatus having a refrigeration cycle according to claim 6 or 7 wherein an amount of said flammable refrigerant in said refrigeration cycle when said refrigeration cycle is shipped from a factory, kept in storage and transported is equal to or greater than atmospheric pressure.

* * * * *